US007308971B2

(12) United States Patent
Liebetreu et al.

(10) Patent No.: US 7,308,971 B2
(45) Date of Patent: Dec. 18, 2007

(54) TURN PLATE AND SLIP PLATE CENTERING AND LOCKING MECHANISM

(75) Inventors: Peter N. Liebetreu, St. Louis, MO (US); Paul Roloff, O'Fallon, MO (US); Michael Olsen, Lake St. Louis, MO (US)

(73) Assignee: Hunter Engineering Company, Bridgeton, MO (US)

( * ) Notice: Subject to any disclaimer, the term of this patent is extended or adjusted under 35 U.S.C. 154(b) by 506 days.

(21) Appl. No.: 10/741,051

(22) Filed: Dec. 19, 2003

(65) Prior Publication Data

US 2005/0133309 A1 Jun. 23, 2005

(51) Int. Cl.
*B66F 7/28* (2006.01)
*B66F 7/00* (2006.01)

(52) U.S. Cl. ..... 187/216; 187/218; 187/219; 187/220; 187/203

(58) Field of Classification Search ..... 187/216, 187/217, 218, 219, 220
See application file for complete search history.

(56) References Cited

U.S. PATENT DOCUMENTS 2,208,063 A 7/1940 Wochner
2,577,376 A * 12/1951 Pelouch ..... 187/205
3,143,810 A 8/1964 McClendon
3,231,983 A 2/1966 Bender
3,252,544 A * 5/1966 Lill ..... 254/88
3,479,632 A * 11/1969 Galles
3,539,036 A * 11/1970 Halstead ..... 187/220
3,875,672 A * 4/1975 Castoe ..... 33/203.12
4,267,901 A * 5/1981 Tsujimura ..... 187/220
4,280,280 A * 7/1981 Eck et al.
4,394,798 A 7/1983 Beissbarth
4,501,342 A * 2/1985 Murphy ..... 187/216
4,567,667 A 2/1986 Minagawa et al.
4,664,584 A * 5/1987 Braun et al. ..... 414/541
4,897,926 A * 2/1990 Altnether et al.
4,924,591 A 5/1990 Brodu
5,024,001 A 6/1991 Borner et al.
5,031,726 A * 7/1991 Wakamiya
5,099,956 A * 3/1992 Curran ..... 187/203
5,236,065 A * 8/1993 Isogai ..... 187/219
5,522,139 A * 6/1996 Rossato ..... 33/203.12
5,535,522 A 7/1996 Jackson
5,724,743 A 3/1998 Jackson
5,832,617 A 11/1998 Gill
6,209,209 B1 * 4/2001 Linson et al. ..... 33/203.12
6,532,062 B2 3/2003 Jackson et al.

(Continued)

FOREIGN PATENT DOCUMENTS

DE 2838399 3/1980

(Continued)

*Primary Examiner*—Patrick Mackey
*Assistant Examiner*—Terrell Matthews
(74) *Attorney, Agent, or Firm*—Polster, Lieder, Woodruff & Lucchesi, L.C.

(57) ABSTRACT

A vehicle support system runway with a movable surface for supporting the wheels of a vehicle in such a manner as to permit a limited range of translational motion about a centered position, having an automatic centering and locking system. The centering and locking system is configured to releasably secure the movable surface in a locked configuration at a centered position, in response to a remote command.

14 Claims, 11 Drawing Sheets

U.S. PATENT DOCUMENTS

2002/0144414 A1 10/2002 Jackson et al.
2003/0098206 A1* 5/2003 Gallese ..... 187/216
2003/0098209 A1* 5/2003 Gallese ..... 187/216
2003/0142294 A1 7/2003 Jackson et al.
2004/0026591 A1 2/2004 Lambrecht et al.
2006/0143931 A1 7/2006 Jackson

FOREIGN PATENT DOCUMENTS

JP 304661 11/2000

* cited by examiner

TURN PLATE AND SLIP PLATE CENTERING AND LOCKING MECHANISM

CROSS-REFERENCE TO RELATED APPLICATIONS

Not Applicable.

STATEMENT REGARDING FEDERALLY SPONSORED RESEARCH

Not Applicable.

BACKGROUND OF THE INVENTION

The present invention relates generally to automotive service equipment incorporating vehicle wheel turn plates and slip plates, such as vehicle support systems and vehicle lift racks, and in particular, to vehicle wheel turn plates and slip plates configured with automatic centering and locking mechanisms which may be manually or automatically controlled during vehicle service procedures.

Typically, movable surfaces commonly referred to as turn plates and slip plates are placed on the vehicle support system surface on which the vehicle undergoing an alignment procedure is parked, such as a lift runway, as shown in FIG. 1. A turn plate is typically a round plate mounted on a bearing surface, flush with the surface of the vehicle support system. The turn plate permits the steered wheels of a stationary vehicle to be steered from side to side without requiring lifting of the vehicle, and simultaneously permits limited motion in a horizontal plane. A slip plate is similar in configuration, but is generally rectangular, and permits only motion in the horizontal plane, without permitting any rotational movement. These movable surfaces are commonly utilized in order to prevent the vehicle suspension from binding during an alignment adjustment process. Prior to driving a vehicle over the vehicle support surface, and at certain times before and during the measurement of a vehicle suspension system, these movable surfaces must be locked into position to prevent unintentional movement of the vehicle.

For example, during a conventional vehicle wheel alignment procedure, the vehicle is driven onto the vehicle support system with the movable surfaces in a locked configuration. Next, sensors are mounted to the vehicle wheels, and the sensors compensated before actual vehicle alignment measurements are acquired. The compensation procedure is required to eliminate errors in alignment angle measurements resulting from runout of the vehicle wheel, the wheel adaptor, or wheel alignment sensor mounting shaft. The compensation procedure can be performed by rotating the vehicle wheels with the vehicle raised off the runway surface, or alternatively, by rolling the vehicle over a limited range on the runway surface with the wheel alignment sensors attached to the wheels, i.e. "rolling compensation."

To carry out the procedure for rolling compensation, it is required that the vehicle be rolled backwards off the turn plates approximately 10-20 inches and then rolled forward so that it is returned to the original starting position. Prior to rolling the vehicle, the turn plates and slip plates over which the vehicle will roll must be in the locked position. Often, a device is used to "bridge" a gap between the runway surface and the edge of each turn plate, permitting the vehicle to roll easier.

Following the compensation procedure, the bridge, if present, is either removed or placed in a lowered position to avoid interfering with the range of motion of the turn plate, and the turn plate and slip plate are unlocked from their stationary positions. The alignment measurements and any corrective procedures are then carried out in a conventional manner. Once the alignment procedures have been completed the movable surfaces must again be locked into a stationary configuration before the vehicle may be driven off the vehicle support system.

Movable surfaces such as turn plates and slip plates may be either manually operated or automatically operated. Conventional designs for manually operated turn plates and slip plates require an operator to manually lock the movable surface in place, and typically rely upon the placement and removal of pins to lock the plates in place.

Automatically operated turn plates and slip plates rely on pneumatic cylinders to pneumatically lock the turn plates and slip plates. Two companies are known to produce pneumatically locked turn plates and slip plates, Omer S.p.A. of Italy, and Otto Nuβbaum GmbH & Co. KG of Germany. These designs employ pneumatic cylinders to push the slip plates toward the longitudinal centerline of the vehicle lift rack or supporting surface in response to an operator command, locking them in place. However, the pneumatic cylinders do not center the slip plates on the longitudinal centerlines of each associated runway. A disadvantage to this design is that the slip plates must be narrower than the runway. If not, the locked slip plates will extend over the inner edge of the lift rack runway and possibly interfere with the movement of centrally disposed jacking elements configured for lifting the vehicle above the lift rack runway surfaces.

Accordingly, it would be advantageous to develop an automatic mechanism for simultaneously locking the turn plates and slip plates of a vehicle support system against planar and rotational movement, and for centering the locked turn plates and slip plates on the longitudinal centerline of the associated vehicle support system runways. It would be further advantageous to provide an operator with either one-touch control for simultaneously locking and unlocking all turn plates and slip plates associated with a vehicle support system, or alternatively, controlling the automatic mechanism through a vehicle service system computer such as a vehicle wheel alignment system, thereby reducing the number of times an operated is required to circle the vehicle during an alignment procedure.

BRIEF SUMMARY OF THE INVENTION

Briefly stated, the present invention provides a vehicle support system runway with a movable surface for supporting the wheels of a vehicle in such a manner as to permit a limited range of planar motion about a centered position, having a mechanical centering and locking apparatus. The centering and locking apparatus is configured to releasably secure the movable surface in a locked configuration at the centered position, in response to a remote command.

In an alternate embodiment, a pneumatically operated centering and locking mechanism of the present invention associated with a vehicle support system turn plate consists of a single pneumatic cylinder operated to rotate a planar cam wheel. The planar cam wheel is configured with a set of slots. Guide pins are engaged in the set of slots, coupling the planar cam wheel to set of clamp arms. As the pneumatic cylinder extends to rotate the planar cam wheel, the guide pins are moved radially by the set of slots, resulting in symmetrical movement of the clamp arms inward to contact a disc rigidly coupled to the axis of the turn plate. Symmetrical engagement of the arms with the disc drives the disc to a centered position, and inhibits subsequent rotation or translational movement. Retraction of the pneumatic cylinder reverses the process, and disengages the arms from the disc, permitting free rotation and translational movement of the turn plate.

In an alternate embodiment, the turn plate centering and locking mechanism of the present invention is configured to bias the turn plate to a locked and centering position, and to disengage to permit free rotation and translational movement of the turn plate upon actuation of the pneumatic cylinder.

In an alternate embodiment, the turn plate centering and locking mechanism of the present invention is configured with a solenoid actuator.

In an alternate embodiment of the present invention, the turn plate centering and locking mechanism further includes articulating components configured to automatically raise a bridge structure between the turn plate and the vehicle supporting runway in conjunction with the turn plate locking and centering action. The mechanism is further configured to lower the bridge structure when the turn plate is unlocked. The articulating components preferably do not utilize additional cylinders or solenoids to actuate the bridge, and are driven by the mechanism that actuates the turn plate lock.

In an alternate embodiment of the present invention, the turn plate centering and locking mechanism of the present invention is configured with one or more additional cylinders or solenoid actuators for locking and centering the turn plate, and/or for raising and lowering the bridge structure.

In an alternate embodiment of the present invention, a pneumatically operated centering and locking mechanism of the present invention associated with a vehicle support system slip plate consists of at least one pneumatic cylinder configured to slide a spring-biased locking assembly into engagement with a pair of centering pins secured to the under side of a movable slip plate structure. The locking assembly captures the pair of centering pins in associated guide slots and retaining recesses, thereby holding them in place. The guide slots on the locking assembly are configured to move the slip plate to a position that is on the longitudinal centerline of the associated vehicle support runway, where the centering pins are held in the retaining recesses.

In an alternate embodiment, the centering and locking mechanism of the present invention associated with a vehicle support slip plate is configured to bias the slip plate to a locked and centering position, and to disengage to permit free movement of the turn plate upon actuation of the pneumatic cylinder.

The foregoing and other objects, features, and advantages of the invention as well as presently preferred embodiments thereof will become more apparent from the reading of the following description in connection with the accompanying drawings.

BRIEF DESCRIPTION OF THE SEVERAL VIEWS OF THE DRAWINGS

In the accompanying drawings which form part of the specification.

DESCRIPTION OF THE PREFERRED EMBODIMENT

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention.

Figure 1:
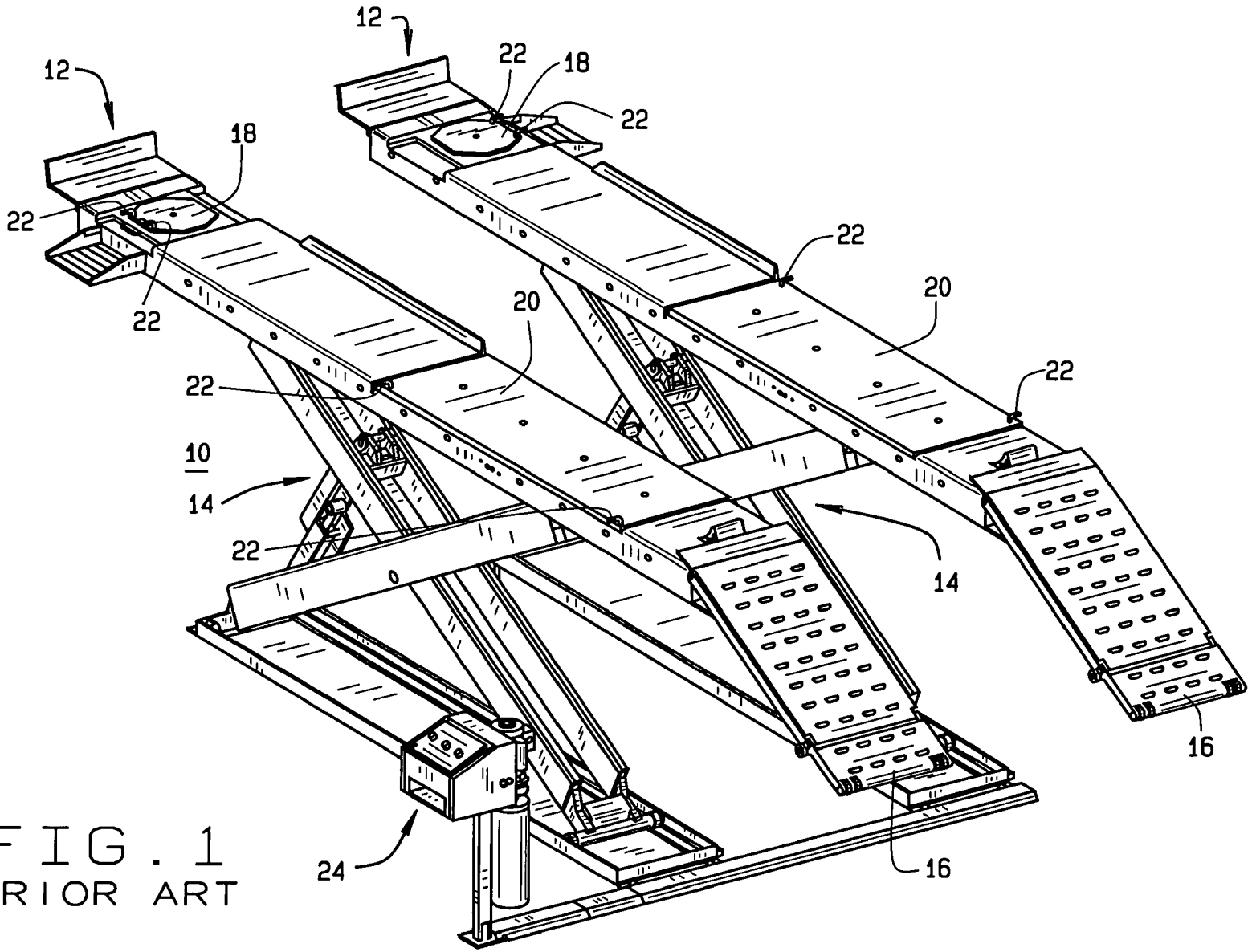
FIG. 1 PRIOR ART
FIG. 1 is a perspective view of a prior art vehicle support system including a pair of scissor-mounted runways.

Turning to FIG. 1, a prior art vehicle support system is shown generally at 10. The vehicle support system 10 consists of an identical pair of adjacent runways 12, each configured to support a vehicle. Each runway 12 is optionally mounted on a lift structure 14, which forms no part of the present invention, such as a hydraulically actuated scissor mechanism. During use, a vehicle is driven onto the runways 12 via a pair of inclined ramps 16 at the rear of the runways. The front vehicle wheels are stopped on conventional turn plates 18 at the front of the runways 12, and the rear vehicle wheels are disposed on conventional slip plates 20. While the vehicle is driven onto and over the turn plates 18 and the slip plates 20, the movable surfaces are locked in place manually by removable pins 22 coupling the movable surfaces to the rigid structure of the runways 12. The lift structures 14 are then actuated from a control console 24, simultaneously raising both runways 12 to a desired vehicle service height.

Those of ordinary skill in the art will recognize that a wide variety of vehicle support systems are known, such as, but not limited to post lifts, side lifts, and floor-mounted runways. While the inventive aspects of the present invention are described below in connection with a vehicle support system having a pair of vertically movable adjacent runways, those of ordinary skill in the art will recognize that the inventive aspects of the present invention may be utilized with any type of vehicle support system, or alternatively, independently of a vehicle support system as portable movable surfaces onto which a vehicle may be driven.

Figure 2:
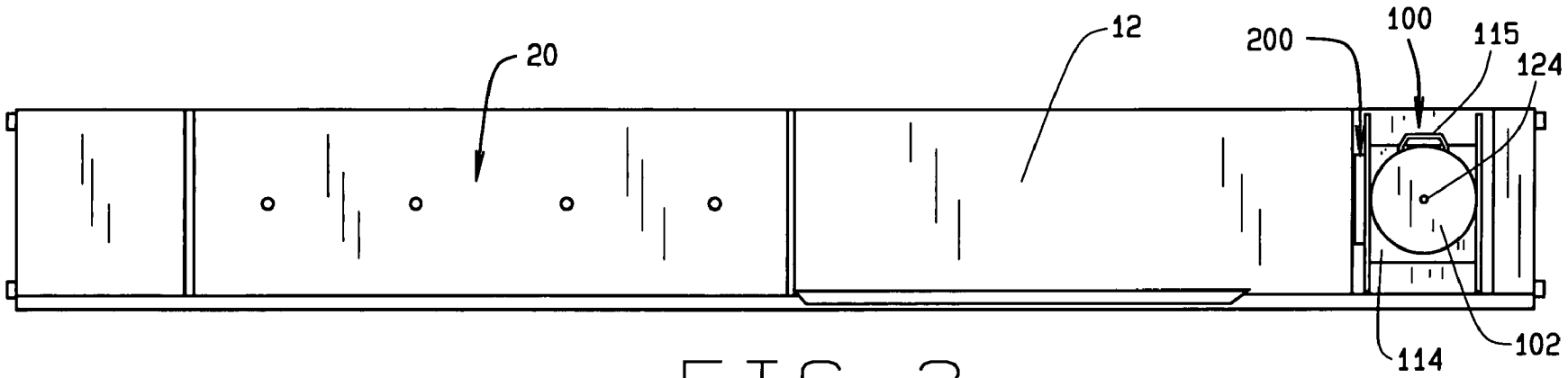
FIG. 2 is a top plan view of a vehicle support system runway, incorporating a turn plate and slip plate of the present invention.
Figure 3:
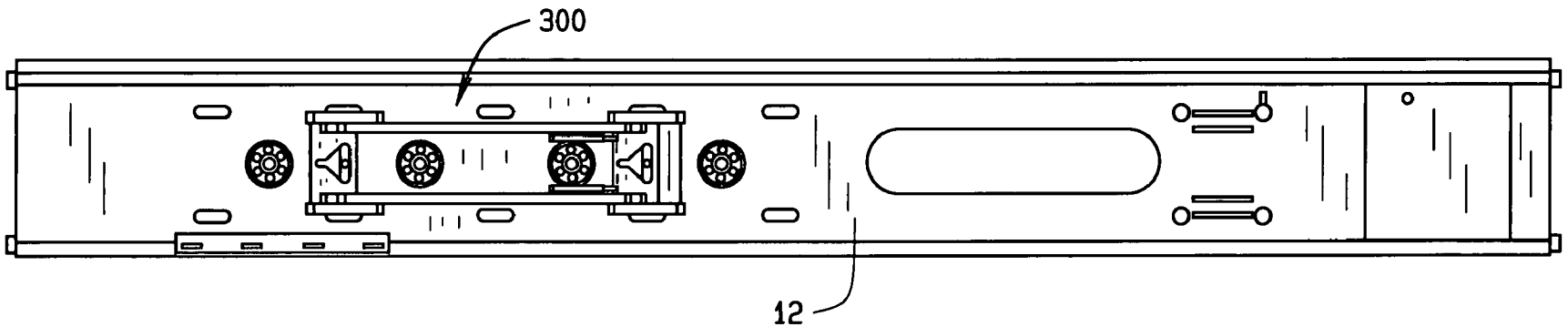
FIG. 3 is a bottom plan view of the vehicle support system runway of FIG. 2.

As shown in FIGS. 2 and 3, a turn plate 100 and slip plate 300 of the present invention may be employed on a runway 12. The turn plate 100 is typically disposed adjacent the front end of the runway 12, in the anticipated position of the steered wheels of a vehicle parked on the runway 12. Correspondingly, the slip plate 300 is disposed adjacent the rear end of the runway 12 and extends longitudinally, covering the anticipated positions of the rear wheels of a wide range of vehicles parked on the runway 12. Additionally illustrated in FIG. 2 is the position of a bridge structure 200, disposed between the circumferential edge of the turn plate 100 and the surface of the runway 12, providing a level surface between the two, over which a vehicle wheel may travel.

Figure 4:
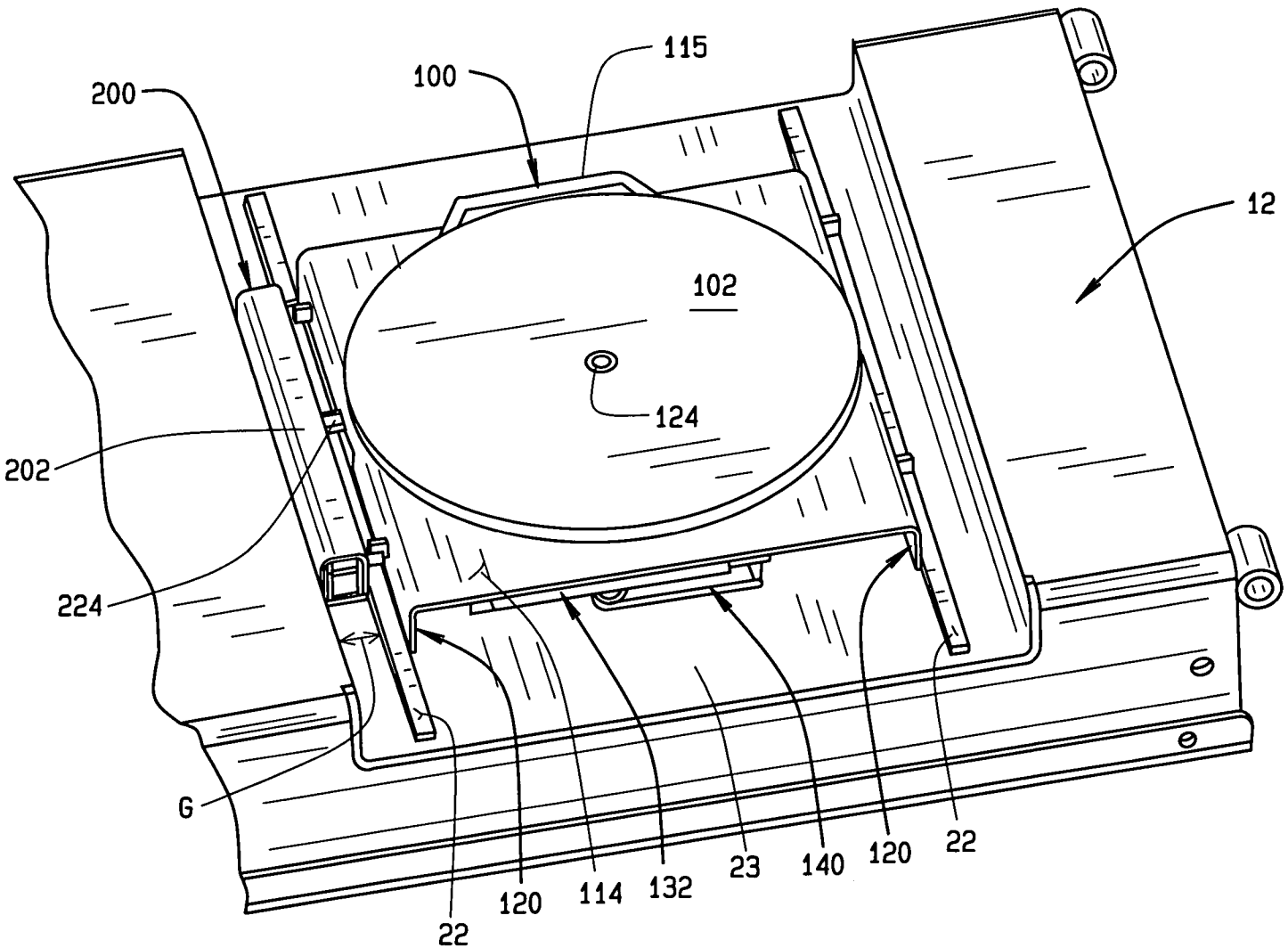
FIG. 4 is an enlarged perspective view of a turn plate of the present invention installed on a vehicle support system runway.

As best seen in FIG. 4, the turn plate 100 of the present invention is preferably removable from the runway 12. The turn plate 100 is placed in a recessed segment 23 on the front upper surface of the runway 12, and seated between a pair of guides 22. The depth of the recessed segment 23 corresponds to the vertical thickness of the turn plate 100, such that a vehicle driven onto the runway 12 and the turn plate 100 remains in a level configuration.

Figure 5:
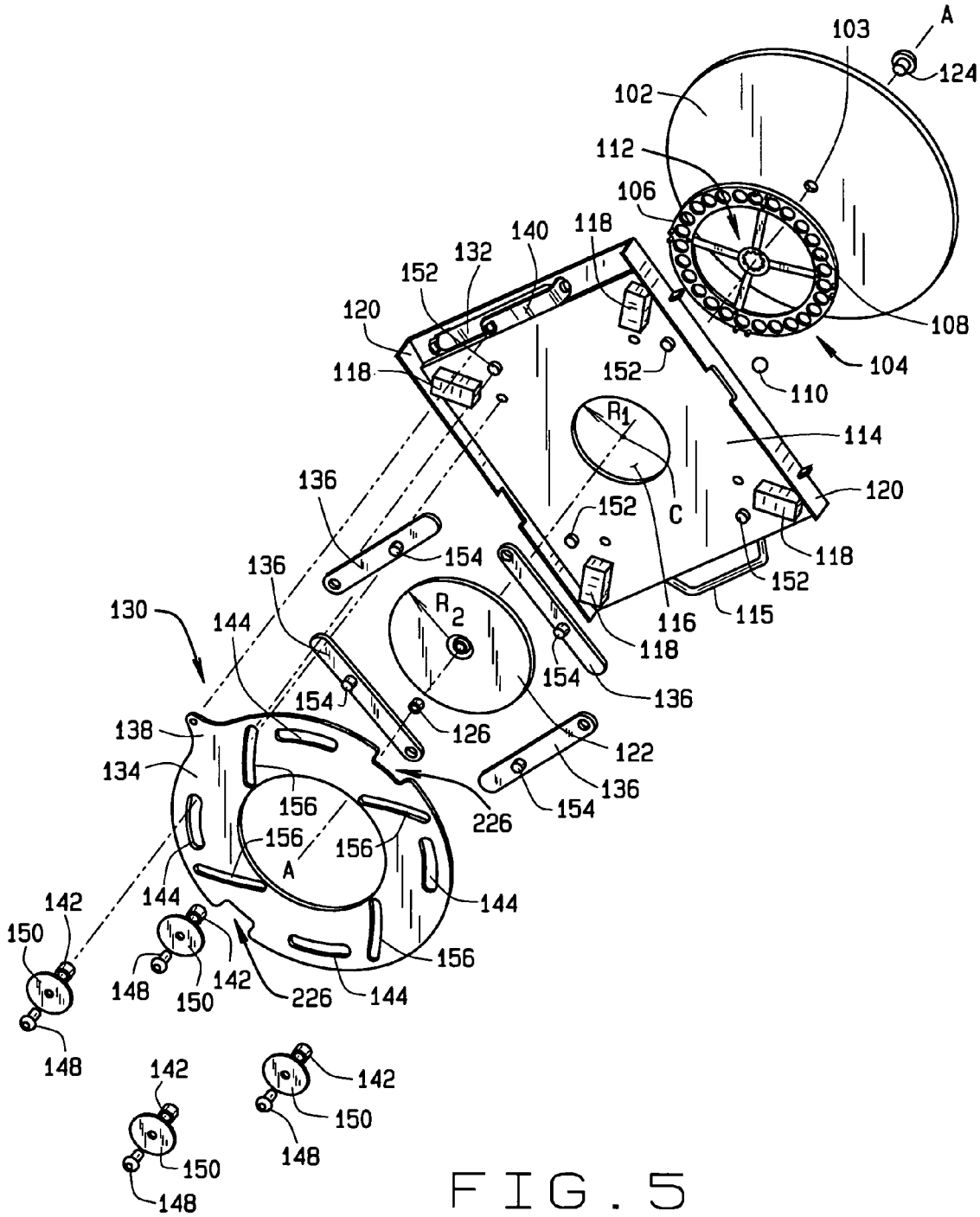
FIG. 5 is an underside exploded view of the turn plate of FIG. 4 in an unlocked configuration.

Turning to FIG. 5, the turn plate 100 consists of a disc-shaped wheel support surface 102 having an axial bore 103 defining an axis A-A, and disposed on a bearing assembly 104. The bearing assembly 104 comprises a planar annular member 106 having a plurality of adjacent holes 108 disposed about the circumference thereof. Each adjacent hole 108 defines an individual bearing retaining cage, within which is disposed a ball bearing 110. An guide structure 112 is axially disposed within the inner circumference of the planar annular member 106, and functions to maintain the planar annular member 106 in an axially centered configuration with respect to the axis A-A of the wheel support surface 102.

The bearing assembly 104 is, in turn, disposed on a rectangular turn plate base 114, concentric with a centrally disposed opening 116 in the base 114, having a center point C. A handle 115 is provided on the base 114 to facilitate movement of the turn plate 100 by an operator. A set of spacers 118 and integrally formed supporting flanges 120 elevate the underside of the turn plate base 114 from a supporting surface on which it is placed, such as the recessed segment 23 of a runway 12.

The support surface 102 is coupled to the base 114 by a retaining disc 122 secured adjacent the underside of the base 114 to the support surface 102. The retaining disc has a radius $R_2$ which is greater than the radius $R_1$ of the opening 116, and is retained by an bolt 124 seated in the axial bore 103 of the support surface 102 and passing through the opening 116 to a cylindrical threaded coupling, such as a guide collar, axially disposed on the retaining disc 122. A retainer 126 is secured against the end of the bolt 124 on the opposite side of the retaining disc 122. The bolt 124 passes axially through the bearing assembly 104, and captures the bearing assembly 104 between the underside of the support surface 102 and the upper surface of the base 114. The bolt 124 and associated guide collar, maintain the support surface 102, the bearing assembly 104, and the retaining disc 122 in a fixed concentric relationship about the axis A-A.

To provide for a limited range of rotational and translation movement of the support surface 102 parallel to the plane of the base 114 in an unlocked or open configuration, the bolt 124 and associated guide collar is unrestrained within the opening 116 in the base 114. Accordingly, the axis A-A of the bolt 124, associated guide collar, bearing assembly 104, support surface 102, and retaining disc 122 is free to translate a radial distance approximately equal to $R_1$ from the axial center point C of the opening 116, restrained only be the interaction between the outer cylindrical surface of the bolt 124 or associated collar and the inner edge of the opening 116. Correspondingly, the support surface 102, bolt 124, and rigidly fixed retaining disc 122 are free to rotate about the axis A-A.

To secure the support surface 102 in a locked and axially centered position relative to the base 114, an automatic locking, centering, and retention (LCR) system 130 is disposed adjacent the underside of the base 114, partially concentric with the retaining disc 122. The LCR system 130 consists of a linear actuator 132, an annular actuating member 134, and a set of engaging arms 136. The linear actuator 132 is preferably a pneumatic cylinder, configured to transition between a retracted position, in which the support surface 102 is in an unlocked or open configuration, and an extended position, in which the support surface 102 is locked in a centered configuration. Those of ordinary skill in the art will readily recognize that the linear actuator 132 may be configured in an alternate embodiment in a reverse configuration, i.e., to transition between a retracted position, in which the support surface 102 is in a centered and locked configuration, and an extended position, in which the support surface 102 is in an unlocked or open configuration.

The linear actuator 132 is coupled to a tab 138 on the peripheral edge of the annular actuating member 134 by a link arm 140. The annular actuating member is secured to the underside of the base 114 by a set of optional bearings 142 passing through a set of arcuate slots 144 equidistantly disposed about the annular actuating member. Each optional bearing 142 is retained within a correspond slot 144 by an axial retaining bolt 148 and a washer 150. The configuration and placement of the arcuate slots 144, and the roller bearings 142 permits a limited range of rotational movement of the annular actuating member 134 parallel to the support surface 102, about an axis passing through the center point C of the opening 116 in the base 114.

Each engaging arm 136 is pivotally secured at one end, parallel to the underside of the base 114, about a pivot pin 152 (optionally with a bearing), and co-planar with the retaining disc 122. Each pivot pin 152 is disposed equidistantly from the center point C of the base opening 116, on a common circumference. A second pivot pin 154 is disposed on the underside of each engaging arm 136, displaced longitudinally along the engaging arm 136 from a pivot axis defined by the connection with pivot pin 152. Each second pivot pin 154 is seated within a corresponding slot 156, optionally with a bearing, disposed in the annular actuating member 134, configured such that rotational movement of the annular actuating member 134 results in a radial displacement of the second pivot pin 154 with the slot 156, and correspondingly, a rotation of each engaging arm 136 about an associated pivot pin 152.

Figure 6:
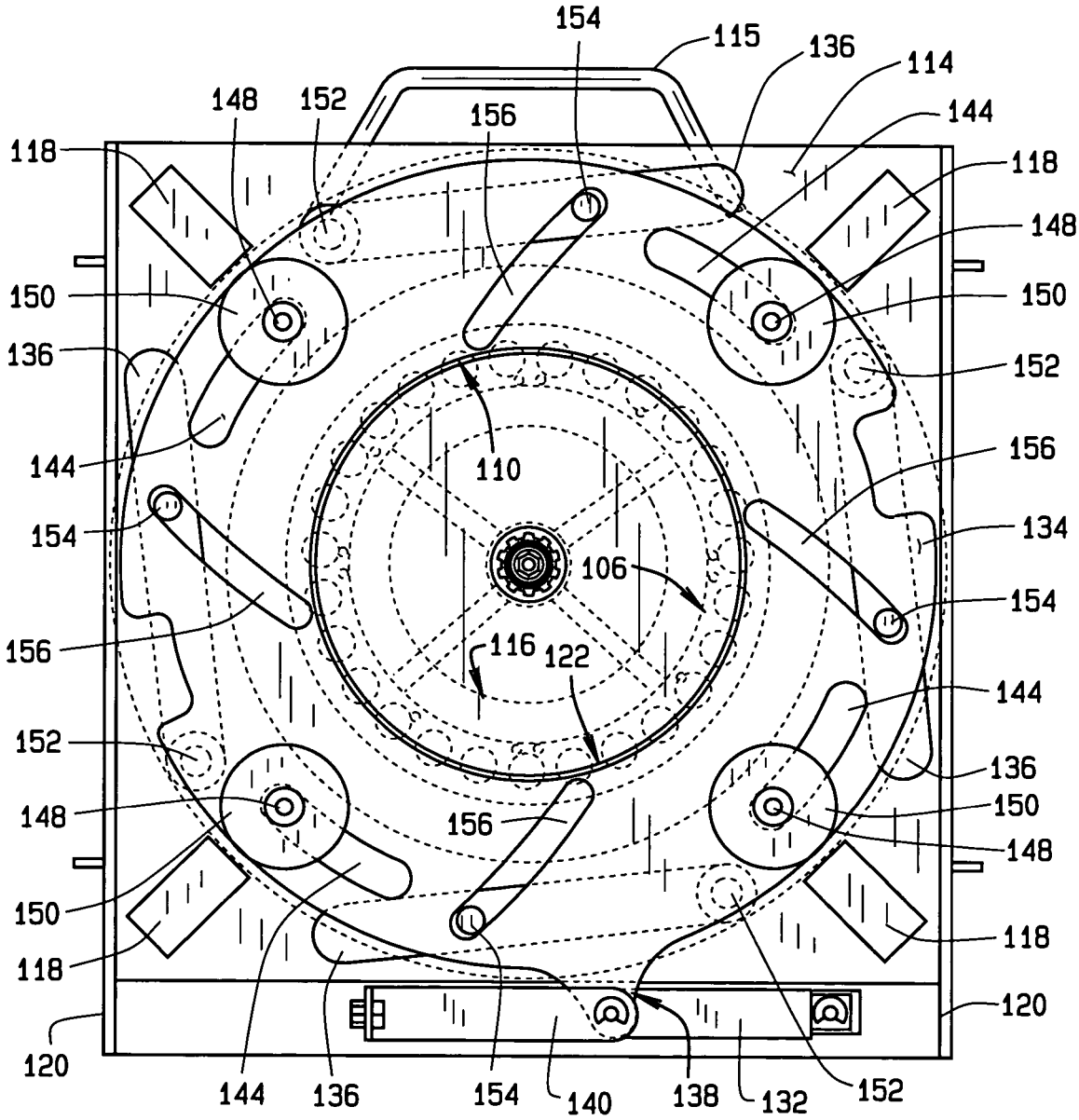
FIG. 6 is an underside plan view of the turn plate of FIG. 4 in an unlocked configuration.
Figure 7:
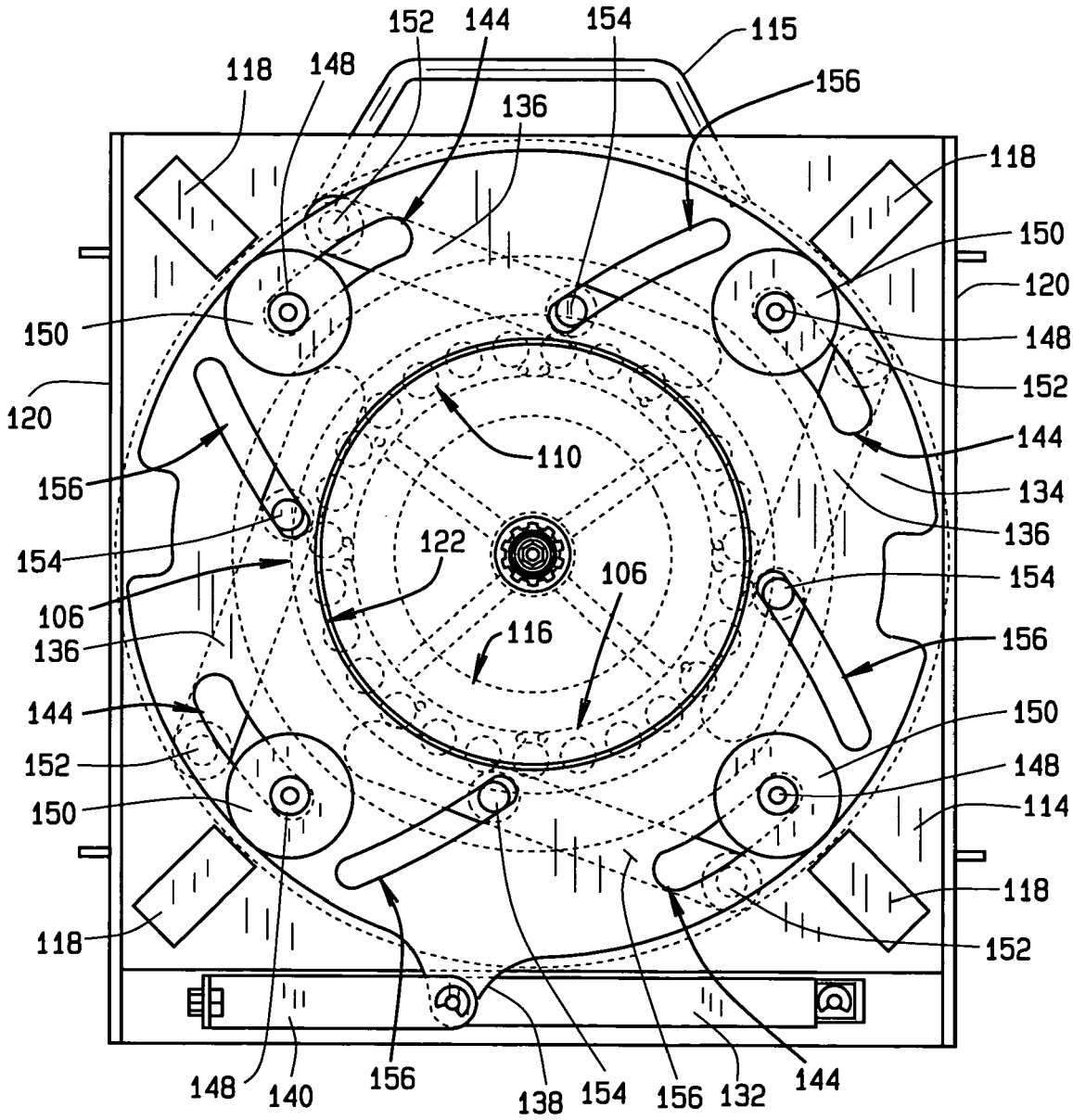
FIG. 7 is an underside plan view of the turn plate of FIG. 4 in a locked and centered configuration.

Referring to FIGS. 6 and 7, operation of the LCR 130 will be readily apparent to those of ordinary skill in the art. In the unlocked and open configuration, shown in FIG. 6, where the support surface 102 is free to rotate and translate with a horizontal plane, the linear actuator 132 is in a fully retracted position. With the linear actuator 132 in the retracted position, the annular actuating member 134 is rotated such that each engaging arm 136 is symmetrically pivoted about a corresponding pivot pin 152 in a radially outward direction from the center point C of the base opening 116.

To lock the support surface 102 in a centered position axially corresponding to the center point C of the base opening 116, the linear actuator 132 is extended, effecting a rotation of the annular actuating member 134 from the first position shown in FIG. 6 to the second position shown in FIG. 7. The rotational movement of the annular actuating member 134 from the first position to the second position results in corresponding symmetrical rotation of each engaging arm 136 about a corresponding pivot pin 152 as each second pivot pin 154 is radially displaced inward within a slot 156 in the annular actuating member 134.

During this movement, each engaging arm 136 is brought into engagement with the peripheral edge of the retaining disc 122. If the retaining disc 122 is off-center, i.e. the axis A-A of the support surface 102, bearing assembly 104, and retaining disc 122 is not aligned with an axis passing through the center point C of the base opening 116, contact between each of the engaging arms 136 and the peripheral edge of the retaining disc 122 will not be simultaneous. However, as each engaging arm 136 contacts the peripheral edge of the retaining disc 122, the retaining disc 122 is urged to a centered configuration wherein the axis A-A is aligned with an axis passing through the center point C of the base opening 116. Once in the centered configuration, translation movement of the retaining disc 122, and correspondingly, the support surface 102, is restricted by the force exerted by the linear actuator 132, resulting in the interaction of the engaging arms 136 with the retaining disc 122.

Rotational movement is similarly restricted, however, rotational movement about the axis A-A is limited by the frictional forces between the engaging arms 136 and the peripheral edge of the retaining disc 122, and not directly by the force exerted by the linear actuator 132. Optionally, the frictional forces may be enhanced by the inclusion of engaging teeth on the friction surfaces of the engaging arms 136 and the retaining disc 122. The procedure for unlocking and release of the support surface 102 from the centered position is the reverse of the locking procedure.

As is apparent from FIG. 4, a gap G in the level surface defined by the runway 12 and the supporting surface 102 of the turn plate 100 exists between the runway 12 and the supporting surface 102. When the turn plate 100 is in the locked and centered configuration, such as for rolling movement of a vehicle wheel between the runway 12 and the supporting surface 102, it is desired that a coplanar bridge structure 200 be present in the gap G, permitting a smooth rolling motion of the vehicle wheel. However, when the turn plate 100 is in the unlocked and open configuration, it is desired that the bridge structure 200 be either removed or lowered parallel to, and below, the level of the supporting surface 102, to prevent interference with the translational movement of the supporting structure 102.

Figure 8:
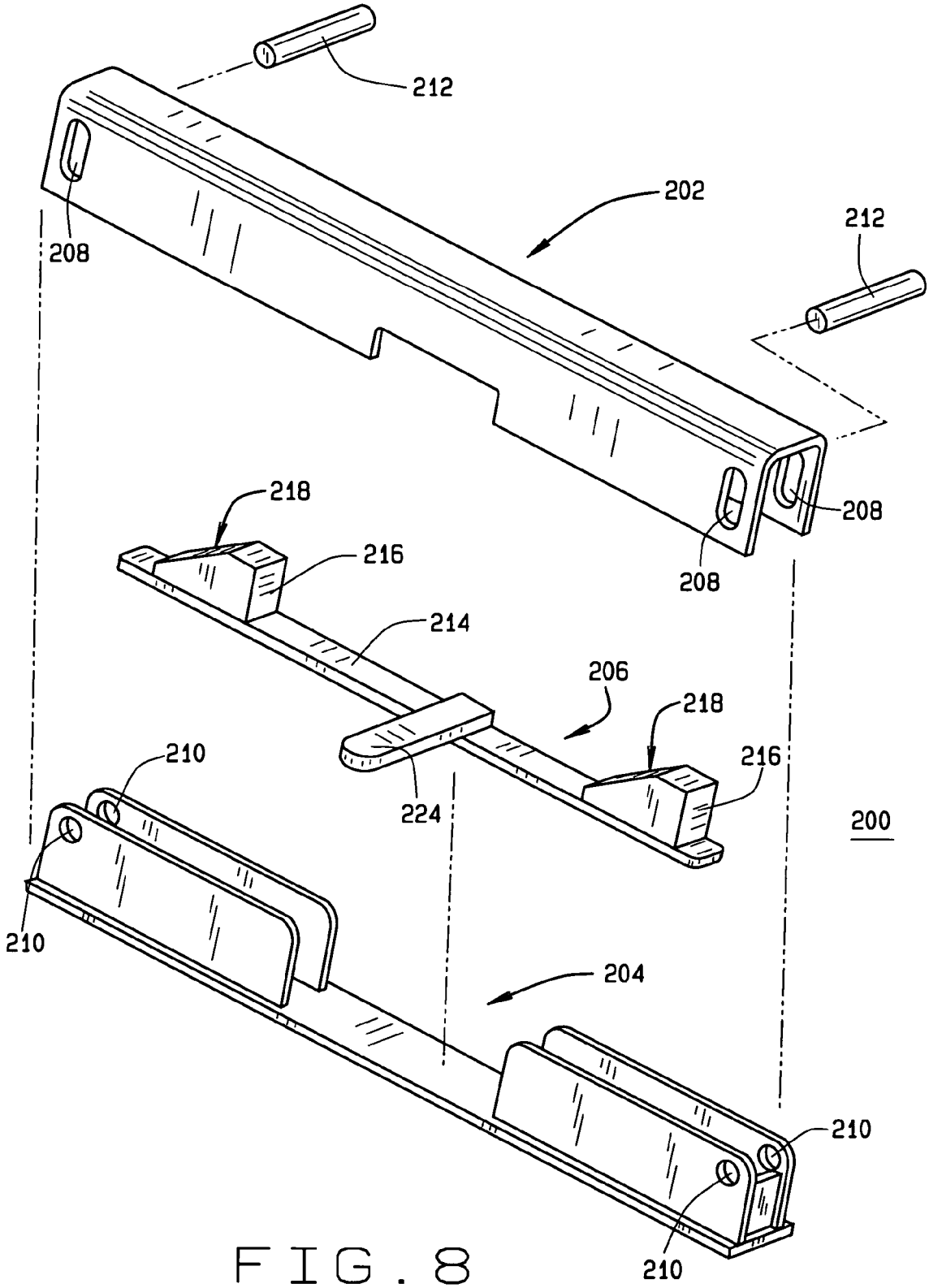
FIG. 8 is an exploded view of an automatic bridge assembly of the present invention.
Figure 9:
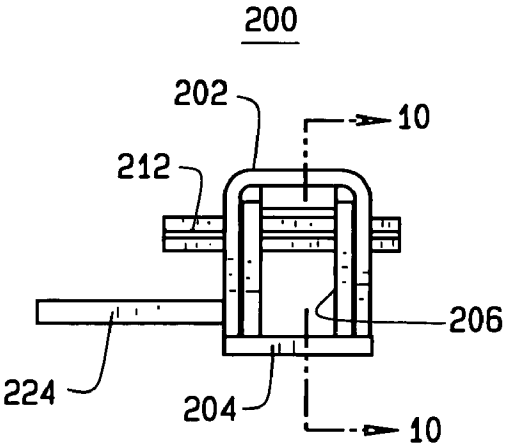
FIG. 9 is an end view of the automatic bridge assembly of FIG. 8.
Figure 10:
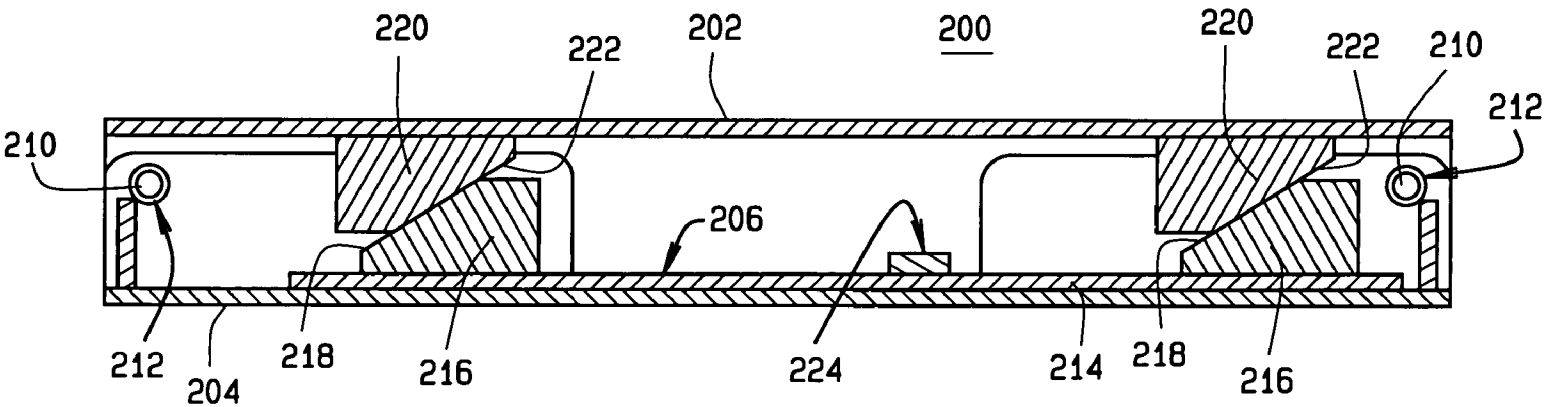
FIG. 10 is a sectional view of the automatic bridge assembly of FIG. 8, taken along line A-A.

Traditionally, an operator is required to install or manually raise a bridge structure, and subsequently remove or manually lower the bridge structure when required for vehicle travel. A bridge structure 200 of the present invention shown in FIG. 8 through FIG. 10 is configured for automatic raising and lowering, preferably in conjunction with the automatic locking and unlocking of a turn plate 100 of the present invention. The bridge structure 200 consists of inverted U-shaped elongated body 202, a base structure 204, and an actuating member 206. As best shown in FIG. 8, the actuating member 206 is enclosed between the body 202 and base structure 204. The body 202 includes a two pairs of vertically elongated slots 208, which align with corresponding transverse bores 210 in the base structure 204. As shown in FIG. 10, a roll pin or bolt 212 passes transversely through each slot 208 and bore 210, retaining the body 202 and base structure 204 in a vertically adjustable relationship.

Vertical adjustment of the body 202 relative to the base structure 204 is effected by interaction of the actuating member 206 and the body 202. The actuating member 206 preferably consists of an elongated slide member 214, and a pair of slide blocks 216. Each slid block 216 includes an inclined surface 218 oriented in the same direction along the longitudinal axis of the slide member 214. Corresponding slide blocks 220 secured to the underside of the body 202 include inclined surfaces 222 opposing inclined surfaces 218, wherein a longitudinal sliding interaction between slide blocks 216 and 220 results in vertical movement of the body 202 relative to the base structure 204.

Those of ordinary skill in the art will recognize that the sliding movement of the slide member 214 to vertically move the body 202 may be driven by any of a variety conventional actuating components. These may include mechanical, hydraulic, or pneumatic linear actuators disposed internal or external to the bridge structure 200. In the preferred embodiment, the bridge structure 200 is intended for cooperative operation with the turn plate 100 of the present invention.

Accordingly, as seen in FIG. 8, the slide member 214 includes an engaging arm 224 laterally secured thereon. The engaging arm 224 extends laterally from the bridge structure 200, through a resected portion of the body 202, for engagement with a notch 226 in the peripheral edge of the annular actuating member 134 of the turn plate 100. As best seen in FIG. 5, the annular actuating member 134 of the turn plate 100 includes two diametrically opposed peripheral notches 226, aligned with resected portions of the supporting flanges 120, permitting the bridge structure 200 to be reversibly disposed on opposite sides of the turn plate 100.

Rotational movement of the annular actuating member 134 moves the engaging arm 224 laterally, raising the body 202 when the turn plate 100 is locked, and lowering the body 202 when the turn plate 100 is unlocked. In the preferred embodiment, since the vertical movement of the bridge structure 200 is cooperative with the turn plate 100, no separate linear actuators or other movement mechanisms are required.

Those of ordinary skill in the art will recognize that the actuating member 206 may consist of a variety of controllable mechanisms for effecting a vertical movement of the body 202. For example, one or more vertically orientated extending mechanical, pneumatic, or hydraulic cylinders may be employed. Alternatively, a scissor-type lift mechanism driven by a mechanical, pneumatic, or hydraulic actuator may be utilized. Cooperative operation of the bridge structure 200 with the turn plate 100 of the present invention may be achieved through direct mechanical coupling, as described above, or by utilization of a common or simultaneous control signal to the turn plate 100 locking mechanisms and the actuating member 206 of the bridge structure 200.

Figure 11:
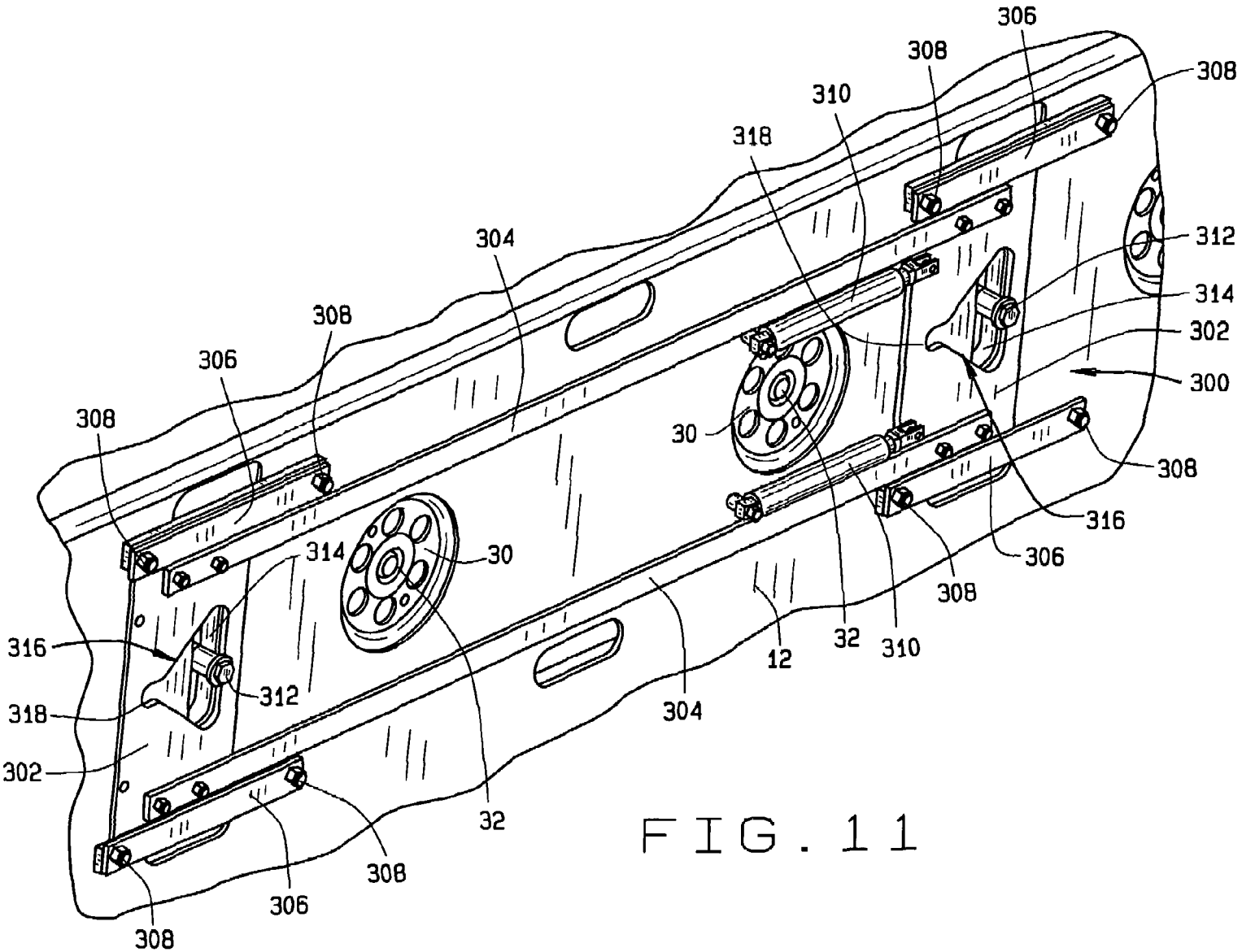
FIG. 11 is a partial perspective view of the underside of a vehicle support system runway of FIG. 2, illustrating the components of a slip plate locking assembly of the present invention.
Figure 12:
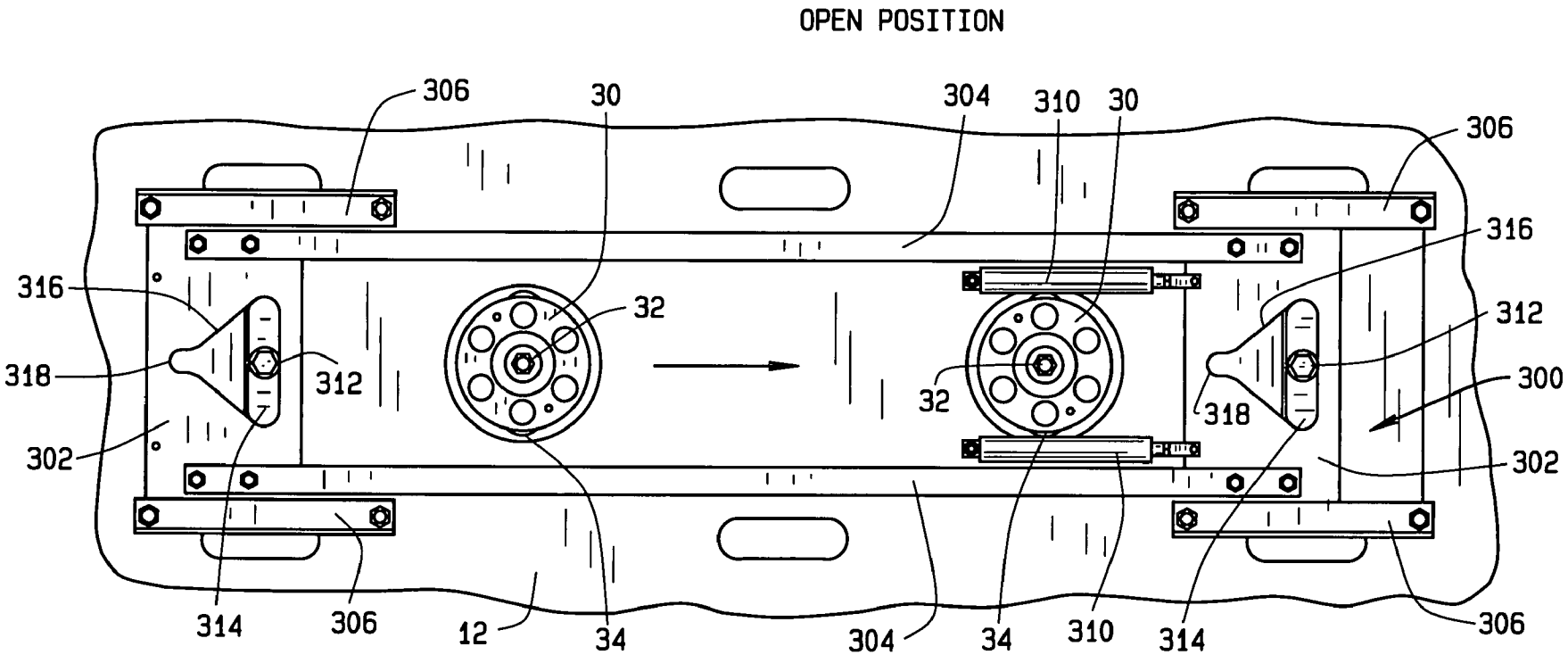
FIG. 12 is a plan view of the slip plate locking assembly shown in FIG. 11 in an unlocked configuration.
Figure 13:
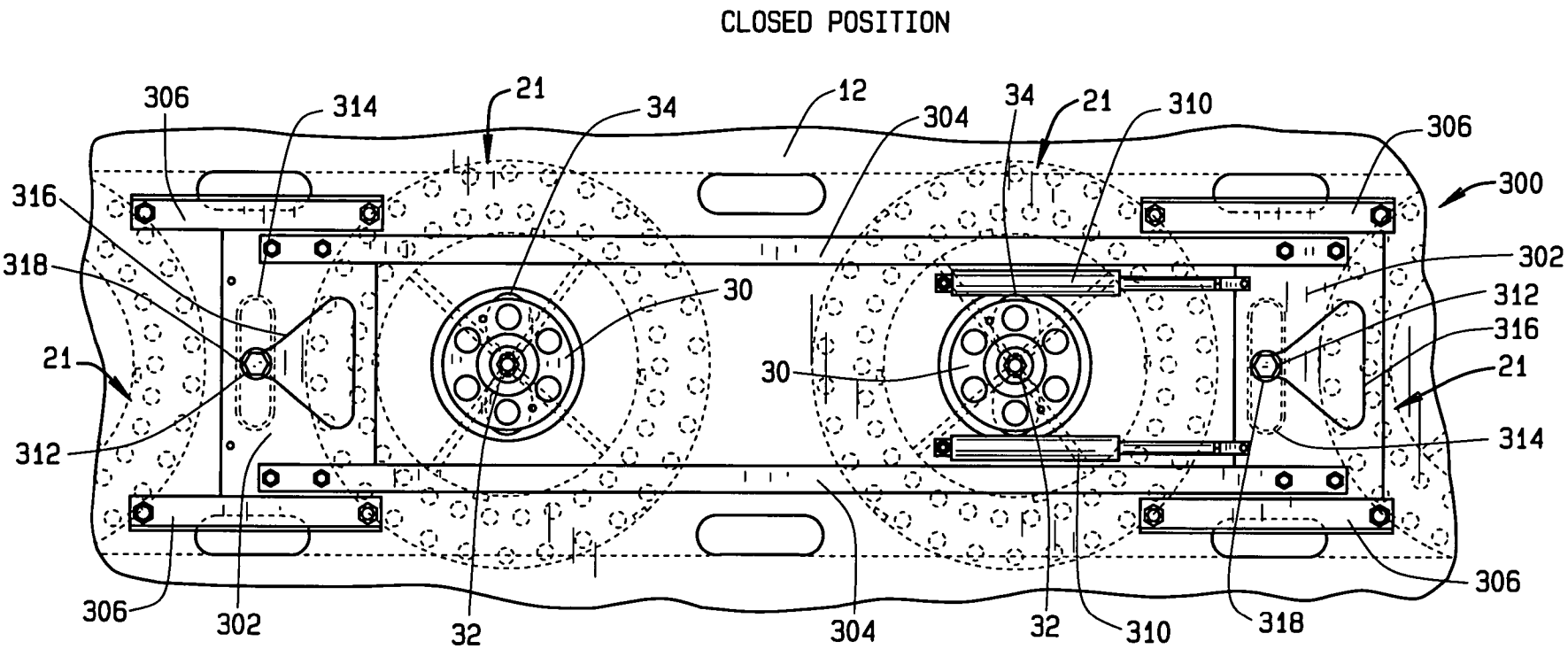
FIG. 13 is a plan view of the slip plate locking assembly shown in FIG. 11 in an locked and centered configuration Corresponding reference numerals indicate corresponding parts throughout the several figures of the drawings.

Turning to FIG. 11 through FIG. 13, an automatic locking and centering mechanism 300 of the present invention is shown configured for operation with a conventional slip plate 20 on a vehicle support system 10. The conventional slip plate 20 is retained on one or more bearing assemblies 21 in a recessed segment on the runway 12 in a conventional manner by two or more retaining discs 30 coupled adjacent the underside of the runway 12 to stub shafts 32 passing through laterally aligned slots 34 in the runway 12. Each stub shaft 32 is secured to the underside of the slip plate 20, and cooperates with an associated retaining disc 30 to restrain the slip plate 20 against vertical movement while permitting a limited range of lateral motion within the constraint of the slots 34, relative to the longitudinal centerline of the runway 12.

The automatic locking and centering mechanism 300 of the present invention secured to the underside of the runway 12 preferably consists of a pair of center locking plates 302 coupled together by a pair of links 304. Those of ordinary skill in the art will recognize that the pair of center locking plates 302 and links 304 may be constructed in a variety of ways, including as a unitary body. Each center locking plate 302 is seated in a set of rails 306 for sliding movement parallel to the runway surface 12. Each set of rails 306 is secured to the underside of the runway surface 12 by retaining bolts 308, or any of a variety of conventional attachment means, symmetrically disposed about the longitudinal centerline of the runway 12.

One or more linear actuators 310 are preferably coupled between the runway 12 and one of the center locking plates 302. Each linear actuator 310 is configured to slide the associated center locking plate 302 along the longitudinal centerline of the runway 12, parallel to the runway surface. Sliding movement of one center locking plate 302 is conveyed to the remaining center locking plates 302 via the links 304, such that each center locking plate 302 slides in unison. Preferably, the linear actuator 310 is spring biased to return to a rest position when an actuating force is withdrawn. Those of ordinary skill in the art will recognize that the operation of the linear actuator 310 and the spring bias may be reversed, i.e. to provide a spring bias to the locked position, and to require actuating force to hold the locking plates 302 in an unlocked position.

To cooperatively engage the automatic centering and locking mechanism 300, the slip plate 20 is configured with two or more centering pins 312 which extend from the underside of the slip plate 20, through laterally aligned slots 314 in the runway 12. Each centering pin 312 further passes through a triangular centering slot 316 in each center locking plate 302. Centering slots 316 are similarly disposed in each center locking plate 302, such that the triangular shape of the centering slot 316 is bisected by the longitudinal midline of the runway 12. A pin receiving detent 318 is disposed at the bisected apex of each centering slot 316, having a radial dimension corresponding to the outer radial dimension of the associated centering pin 312. Each centering slot 316 has a lateral width opposite the pin receiving detent 318 which is equal to, or slightly wider than, the laterally aligned slots 314 in the runway 12 through which each centering pin 312 passes, thereby preventing interference with lateral movement of the slip plate 20 when in an unlocked configuration.

During a preferred operation, the automatic centering and locking mechanism 300 is preferably biased to an unlocked configuration, shown in FIG. 11 and FIG. 12. In the unlocked configuration, each centering pin 312 is unrestrained against lateral movement within the associated lateral slot 314. To center and lock the slip plate 20, the linear actuators 310 are extended, driving each center locking plate 302 along the longitudinal axis of the runway 12, as indicated by the arrow in FIG. 12. Correspondingly, the centering slots 316 slide over the lateral slots 314, capturing and restraining each centering pin 312 in a pin receiving detent 318. Interaction with the inner edges of the centering slots 316 guide each centering pin 312 to the corresponding pin receiving detent 318, centering the slip plate 20 over the longitudinal centerline of the runway 12. The slip plate 20 is secured in the locked and centered configuration until the linear actuators 310 are released, permitting the spring bias to retract the centering slots 316, and releasing each centering pin 312 for lateral movement. As previously stated, those of ordinary skill in the art will readily recognize that the linear actuation and spring bias forces may be reversed without changing the scope of the present invention.

Those of ordinary skill in the art will recognize that a wide variety of, and number of, linear actuators 310 may be employed within the scope of the present invention. For example, the linear actuators may be mechanical, electrical, pneumatic, or hydraulically driven. Each center locking plate 302 may be configured with an associated linear actuator, eliminating the need for the links 304, provided movement of each linear actuator can be controlled within a required tolerance. Those of ordinary skill in the art will further recognize that the specific number, shape, and size of the centering slots 316 may be varied from that which is described herein, provided that the automatic centering and locking mechanism 300 retains the ability to engage the slip plate 20 in any position, and to move the slip plate 20 to a centered position, aligned with the longitudinal centerline of the runway where it is maintained in a locked configuration until released.

Those of ordinary skill in the art will recognize that a wide variety of control systems may be employed with the turn plates 100, bridge structures 200, and slip plates 20 of the present invention. For example, locking (or unlocking) control of each turn plate 100 and slip plate 20, and raising and lowering control of the bridge structures 200 may be from one or more mechanical or electrical buttons, valves, or levers on the vehicle support system control console 24. This allows an operator to have full control over the status of the vehicle support system and movable surfaces from a single location, providing a time savings over conventional systems requiring the manual pulling pins on each movable surface and the manual positioning of a bridge.

The controls for each movable surface 100, 20 and the bridge structure 200 may be combined, permitting an operator to simultaneous lock (or unlock) two or more movable surfaces from a single control. Correspondingly, if the bridge structure 200 actuation is coordinated with the locking and unlocking of a turn plate 100, no separate control for the bridge structure 200 is required. Those of ordinary skill in the art will further recognize that the specific nature of the control systems employed with the present invention will vary depending upon the particular type of actuating mechanisms utilized. For example, hydraulic and pneumatic control systems will differ from direct electronic control of solenoids.

In an alternative embodiment, controls for each movable surface 100, 20 and the bridge structures 200 may be implemented in a set of computer program instructions, and incorporated into a vehicle service system, such as a vehicle wheel alignment system. As the vehicle service system progresses through a vehicle service procedure, such as a vehicle wheel alignment, the set of computer program instructions is accessed by the vehicle service system as required to either automatically center and lock the movable surfaces 100, 20 as required, or to raise and lower the bridge structure 200 as required, eliminating the need for an operator to either actuate the controls or to manually lock/unlock the movable surfaces 100, 20. In addition to saving a substantial amount of time this implementation will also help to ensure that the proper procedure is followed during the vehicle service procedure.

Alternatively, the set of computer program instruction for controlling each movable surfaces 100, 20, and the bridge structures 200 may be accessed to provide the operator with an interactive display on a monitor or other display device associated with a vehicle service system. The interactive display may be representative of one or more control buttons, which the operator may selectively actuate using conventional computer interface components, such as a mouse, keyboard, or touch-screen, to effect control of the movable surfaces and bridge structures directly from the vehicle service system.

The present invention can be embodied in part in the form of computer-implemented processes and apparatuses for practicing those processes. The present invention can also be embodied in part in the form of computer program code containing instructions embodied in tangible media, such as floppy diskettes, CD-ROMs, hard drives, or an other computer readable storage medium, wherein, when the computer program code is loaded into, and executed by, an electronic device such as a computer, micro-processor or logic circuit, the device becomes an apparatus for practicing the invention.

The present invention can also be embodied in part in the form of computer program code, for example, whether stored in a storage medium, loaded into and/or executed by a computer, or transmitted over some transmission medium, such as over electrical wiring or cabling, through fiber optics, or via electromagnetic radiation, wherein, when the computer program code is loaded into and executed by a computer, the computer becomes an apparatus for practicing the invention. When implemented in a general-purpose microprocessor, the computer program code segments configure the microprocessor to create specific logic circuits.

In view of the above, it will be seen that the several objects of the invention are achieved and other advantageous results are obtained. As various changes could be made in the above constructions without departing from the scope of the invention, it is intended that all matter contained in the above description or shown in the accompanying drawings shall be interpreted as illustrative and not in a limiting sense.

The invention claimed is:

1. An improved vehicle support system having a pair of adjacent horizontal runways, each having a longitudinal centerline, a first movable support surface associated with the steered wheels of a vehicle, and a second movable support surface associated with the fixed wheels of the vehicle, the improvement comprising:

a first centering and locking assembly associated with the first movable support surface;

a second centering and locking assembly associated with the second movable support surface;

a bridge structure configured for vertical articulation adjacent said first movable support surface between a raised configuration coplanar with said first movable support surface and a lowered configuration parallel to said first movable support surface, said bridge structure including an automatic raising and lowering system which is configured responsive said one or more remote commands;

wherein said first centering and locking assembly is configured to secure said first movable support surface against translational and transverse movement in a centered configuration on the longitudinal centerline;

wherein said second centering and locking assembly is configured to secure said second movable support surface against translational movement in a centered configuration on the longitudinal centerline; and wherein said first centering and locking assembly and said second centering and locking assembly are configured responsive to one or more remote commands.

2. The improved vehicle support system of claim 1 wherein said bridge structure includes:

a base, said base seated on said runway;

a body coupled to said base for vertical movement relative thereto; and an elongated slide member disposed for sliding movement between said base and said body, said elongated slide member including at least one upright slide block having an inclined surface;

wherein said body includes at least one inverted slide block having an inclined surface; and wherein each of said inclined surfaces is in sliding engagement for raising and lowering said body responsive to movement of said elongated slide member.

3. An improved vehicle support system having a pair of adjacent horizontal runways, each having a longitudinal centerline, a first movable support surface associated with the steered wheels of a vehicle, and a second movable support surface associated with the fixed wheels of the vehicle, the improvement comprising:

a first centering and locking assembly associated with the first movable support surface;

a second centering and locking assembly associated with the second movable support surface;

wherein said first centering and locking assembly is configured to secure said first movable support surface against translational and transverse movement in a centered configuration on the longitudinal centerline;

wherein said second centering and locking assembly is configured to secure said second movable support surface against translational movement in a centered configuration on the longitudinal centerline;

wherein said first centering and locking assembly and said second centering and locking assembly are configured responsive to one or more remote commands; and wherein said first centering and locking assembly includes:

a retaining disc rigidly secured to said first movable support surface, said retaining disc disposed parallel to, and coaxial with, said first movable support surface;

a set of engaging arms disposed coplanar with said retaining disc, each of said engaging arms configured for pivoting movement about an associated pivot point;

an annular actuating member operatively coupled to said set of engaging arms, said annular actuating member coaxially disposed about a centered position of said first movable support surface;

a linear actuator operatively coupled to said annular actuating member, said linear actuator configured to effect a rotational movement of said annular actuating member about said centered position responsive to said one or more remote commands; and wherein rotational movement of said annular actuating member pivots said set of engaging arms into and out of symmetrical locking and centering engagement with said retaining disc.

4. An improved vehicle support system having a pair of adjacent horizontal runways, each having a longitudinal centerline, a first movable support surface associated with the steered wheels of a vehicle, and a second movable support surface associated with the fixed wheels of the vehicle, the improvement comprising:

a first centering and locking assembly associated with the first movable support surface;

a second centering and locking assembly associated with the second movable support surface, said second centering and locking assembly including, at least one centering pin rigidly coupled to an underside of the second movable support surface on a longitudinal centerline of the second movable support surface;

at least one center locking plate disposed below and parallel to the second movable surface, each of said at least one center locking plates associated with one of said at least one centering pins, and including a triangular centering slot surrounding said associated centering pin;

at least one linear actuator operatively coupled to said at least one center locking plate for effecting sliding movement thereof parallel to the second movable support surface;

wherein each of said triangular centering slots is bisected by the longitudinal centerline of the runway, and includes a pin receiving detent disposed at an apex on the longitudinal centerline; and wherein linear movement of said at least one center locking plate is configured to engage and release each of said at least one centering pins in an associated pin receiving detent, locking and centering the second movable support surface on the longitudinal centerline of said runway;

wherein said first centering and locking assembly is configured to secure said first movable support surface against translational and transverse movement in a centered configuration on the longitudinal centerline;

wherein said second centering and locking assembly is configured to secure said second movable support surface against translational movement in a centered configuration on the longitudinal centerline; and wherein said first centering and locking assembly and said second centering and locking assembly are configured responsive to one or more remote commands.

5. An improved vehicle support system having a pair of adjacent horizontal runways, each having a longitudinal centerline, a first movable support surface associated with the steered wheels of a vehicle, and a second movable support surface associated with the fixed wheels of the vehicle, the improvement comprising:

a first centering and locking assembly associated with the first movable support surface;

a second centering and locking assembly associated with the second movable support surface;

wherein said first centering and locking assembly is configured to secure said first movable support surface against translational and transverse movement in a centered configuration on the longitudinal centerline;

wherein said second centering and locking assembly is configured to secure said second movable support surface against translational movement in a centered configuration on the longitudinal centerline;

wherein said first centering and locking assembly and said second centering and locking assembly are configured responsive to one or more remote commands; and further including one or more controls configured to provide said one or more remote commands to said first centering and locking assembly and said second centering and locking assembly, said one or more controls being computer instructions residing in an electronic memory of a vehicle service system associated with the vehicle support system.

6. An improved vehicle support system having a pair of adjacent horizontal runways, each having a longitudinal centerline and a movable support surface associated with the steered wheels of a vehicle configurable between a locked state and an unlocked state, the improvement comprising:

a bridge structure associated with each movable surface, each bridge structure configured for vertical articulation between a raised configuration coplanar with said associated movable support surface and a lowered configuration, each bridge structure including an automatic raising and lowering system.

7. The improved vehicle support system of claim 6 wherein each bridge structure is responsive to one or more remote commands for vertical articulation.

8. The improved vehicle support system of claim 6 wherein each bridge structure is responsive to the state of said associated movable support surface for vertical articulation.

9. The improved vehicle support system of claim 6 wherein said bridge structure includes:

a base, said base seated on said runway;

a body coupled to said base for vertical movement relative thereto; and wherein said automatic raising and lowering system is disposed between said base and said body.

10. The improved vehicle support system of claim 9 wherein said automatic raising and lowering system includes an elongated slide member disposed for horizontal sliding movement between said base and said body, said elongated slide member including at least one upright slide block having an inclined surface;

wherein said body includes at least one inverted slide block having an inclined surface; and wherein each of said inclined surfaces is in sliding engagement for raising and lowering said body responsive to movement of said elongated slide member.

11. The improved vehicle support system of claim 9 wherein said automatic raising and lowering system includes a mechanical actuator.

12. The improved vehicle support system of claim 9 wherein said automatic raising and lowering system includes a pneumatic actuator.

13. The improved vehicle support system of claim 9 wherein said automatic raising and lowering system includes a hydraulic actuator.

14. An improved vehicle support system having a pair of adjacent horizontal runways, each having a longitudinal centerline, at least one movable support surface associated with the wheels of a vehicle, each of said at least one movable support surfaces having a center locked state and an unlocked state for a limited range of planar movement and rotational movement, the improvement comprising:

a centering and locking assembly associated with the each of said at least one movable support surfaces, said centering and locking assembly responsive to one or more remote commands;

one or more controls configured to provide said one or more remote commands, said one or more controls disposed remote from said vehicle support system; and wherein said one or more controls are computer instructions residing in an electronic memory of a vehicle service system operatively coupled to said vehicle support system.

* * * * *